US009360248B1

(12) United States Patent
Efferding

(10) Patent No.: US 9,360,248 B1
(45) Date of Patent: Jun. 7, 2016

(54) BEVERAGE COOLER WITH A SEPARATE, REMOVABLE SHAKER RECEPTACLE

(71) Applicant: Stan Efferding, Henderson, NV (US)

(72) Inventor: Stan Efferding, Henderson, NV (US)

( * ) Notice: Subject to any disclaimer, the term of this patent is extended or adjusted under 35 U.S.C. 154(b) by 0 days.

(21) Appl. No.: 14/210,119

(22) Filed: Mar. 13, 2014

(51) Int. Cl.

| | |
|---|---|
| ***B65D 1/04*** | (2006.01) |
| ***F25D 31/00*** | (2006.01) |
| ***B65D 81/38*** | (2006.01) |
| ***B65D 41/04*** | (2006.01) |
| ***B65D 69/00*** | (2006.01) |
| ***B65D 25/28*** | (2006.01) |
| ***B67D 7/00*** | (2010.01) |
| ***F25D 11/00*** | (2006.01) |
| *A47G 19/22* | (2006.01) |

(52) U.S. Cl.
CPC ..... *F25D 31/002* (2013.01); *B65D 25/28* (2013.01); *B65D 41/04* (2013.01); *B65D 69/00* (2013.01); *B65D 81/3837* (2013.01); *B67D 7/005* (2013.01); *F25D 11/003* (2013.01)

(58) Field of Classification Search
CPC ..... B65D 77/0486; B65D 77/1493; B65D 51/28; B65D 81/3216; B65D 81/3837; B65D 41/04; B65D 69/00; B65D 25/28; F25D 31/002; F25D 3/08; F25D 11/003; A47J 41/02; A47G 19/2288
USPC ..... 220/592.16, 592.17, 23.87, 23.89, 506, 220/522, 568
See application file for complete search history.

(56) References Cited

U.S. PATENT DOCUMENTS

| | | | | |
|---|---|---|---|---|
| 1,954,370 | A * | 4/1934 | Solomon | 222/130 |
| 2,838,194 | A * | 6/1958 | Piker | 215/13.1 |
| 2,941,689 | A * | 6/1960 | Black | 220/522 |
| 4,286,440 | A | 9/1981 | Taylor | |
| 4,351,451 | A * | 9/1982 | Chung | 220/592.16 |
| 5,203,181 | A | 4/1993 | Brossia et al. | |
| 5,328,050 | A * | 7/1994 | Hyatt | 220/506 |
| 5,502,981 | A * | 4/1996 | Sullivan | 62/372 |
| 6,058,733 | A | 5/2000 | Morgan | |
| 7,082,784 | B2 * | 8/2006 | Roth et al. | 62/457.2 |
| 7,269,969 | B2 | 9/2007 | Strickland et al. | |
| 7,614,512 | B2 * | 11/2009 | Nader | 215/6 |
| 8,448,801 | B2 * | 5/2013 | Rusnak et al. | 220/23.86 |
| 8,469,221 | B2 * | 6/2013 | Ullmann et al. | 220/506 |
| 2008/0164266 | A1 * | 7/2008 | Sun | 220/592.16 |
| 2008/0230540 | A1 * | 9/2008 | Marra et al. | 220/23.89 |
| 2009/0223386 | A1 * | 9/2009 | Edwards et al. | 99/455 |
| 2010/0308057 | A1 * | 12/2010 | Hart | 220/506 |
| 2012/0138608 | A1 * | 6/2012 | Rusnak et al. | 220/23.87 |
| 2012/0269025 | A1 | 10/2012 | Liu | |
| 2013/0146048 | A1 * | 6/2013 | Hopfe | 126/704 |
| 2014/0054301 | A1 * | 2/2014 | Guoqing | 220/592.17 |

FOREIGN PATENT DOCUMENTS

| | | |
|---|---|---|
| WO | WO 02/14180 A1 | 2/2002 |

* cited by examiner

*Primary Examiner* — J. Gregory Pickett
*Assistant Examiner* — Niki M Eloshway
(74) *Attorney, Agent, or Firm* — Greenberg Traurig, LLP

(57) ABSTRACT

A beverage cooler having an insulated housing wherein the housing has a bottom and top with the top including a (i) center opening configured to receive a removable lid and (ii) a threaded member on an underside thereof and substantially circumscribing the center opening with the threaded member configured to removably receive a first shaker receptacle within a portion of a total volume defined by the housing. The first shaker receptacle may receive a second shaker receptacle therein such that the first shaker receptacle acts as a sleeve to keep the second shaker receptacle out of contact with a liquid in the beverage cooler. The first and second shaker receptacles may be removed by removing the top and unscrewing the first shaker receptacle from the threaded member on the underside of the top.

6 Claims, 7 Drawing Sheets

BEVERAGE COOLER WITH A SEPARATE, REMOVABLE SHAKER RECEPTACLE

FIELD OF THE INVENTION

The embodiments of the present invention relate to a beverage cooler including a removable shaker receptacle.

BACKGROUND

Beverage coolers conventionally permit a beverage to be stored for later consumption. Ice may be stored as well to maintain the cool temperature beverage. A movable spout permits the beverage to be poured as needed. One disadvantage of beverage coolers is they normally contain a single beverage which may not be sufficient for the user.

It would be advantageous to develop a beverage cooler with a separate, removable shaker receptacle incorporated therewith.

SUMMARY

Accordingly, one embodiment of the present invention comprises a beverage cooler having an insulated cylindrical housing, said housing having a bottom and top, said top including a (i) center opening configured to receive a removable lid and (ii) a threaded member on an underside of said top and substantially circumscribing said center opening, said threaded member configured to removably receive a first shaker receptacle within a portion of a total volume defined by said housing. In other embodiments, the beverage cooler includes a handle and/or movable drinking or pouring spout.

In another embodiment, the beverage cooler may retain multiple shaker receptacles by configuring a first shaker receptacle to receive a second inserted shaker receptacle which are both contained within the beverage cooler and concealed by the beverage cooler lid. The first shaker receptacle may receive a second shaker receptacle therein. In such an embodiment, the first shaker receptacle acts as a sleeve to keep the second shaker receptacle out of contact with a liquid in the beverage cooler. As described herein, the first and second shaker receptacles may be removed by removing the top from the housing and unscrewing the first shaker receptacle from the threaded member on the underside of the top. This arrangement may be repeated such that more than two shaker receptacles may be stored within the beverage cooler.

Other variations, embodiments and features of the present invention will become evident from the following detailed description, drawings and claims.

DETAILED DESCRIPTION

Figure 1:
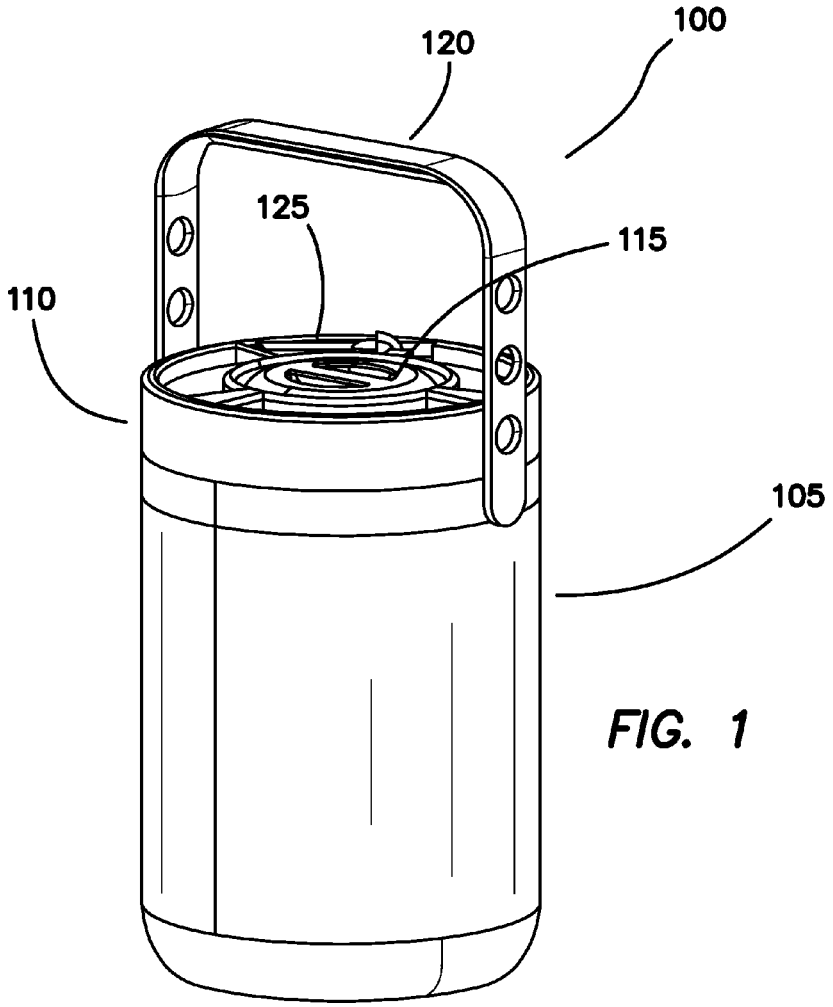
FIG. 1 illustrates a perspective view of a beverage cooler according to the embodiments of the present invention.
Figure 4:
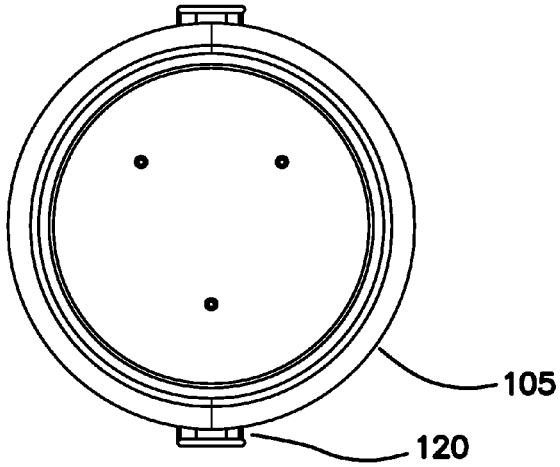
FIG. 4 illustrates a bottom view of the beverage cooler according to the embodiments of the present invention.
Figure 2:
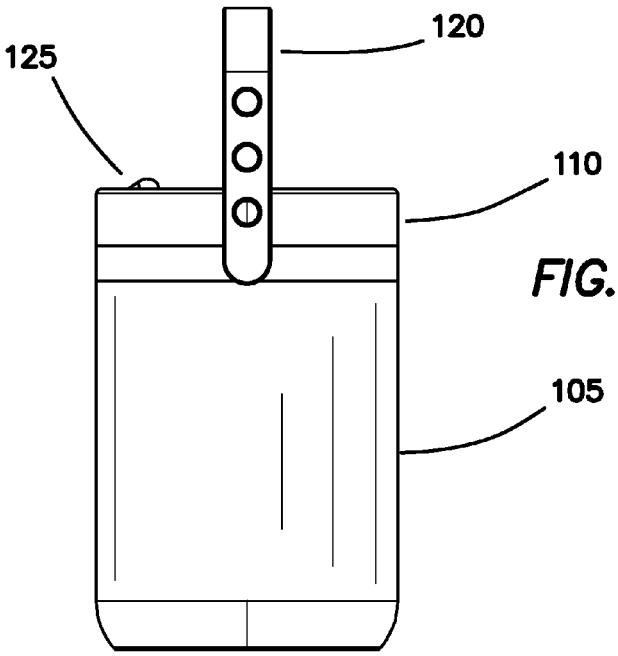
FIG. 2 illustrates a side view of the beverage cooler according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The components of the embodiments of the present invention may be fabricated of any suitable materials, including, but not limited to, plastics, alloys, composites, resins and metals, and may be fabricated using suitable techniques, including, but not limited to, molding, casting, machining and rapid prototyping.

FIGS. 1-4 show various views of a beverage cooler 100 according to the embodiments of the present invention. As shown, the beverage cooler 100 includes an insulated, cylindrical housing 105 having a top 110 with a removable lid 115 centered thereon. Handle 120 provides means for carrying the beverage cooler 100. A drinking or pouring spout 125 provides means for a user to consume the beverage contained within the beverage containment portion 130 of the housing 105.

Figure 3:
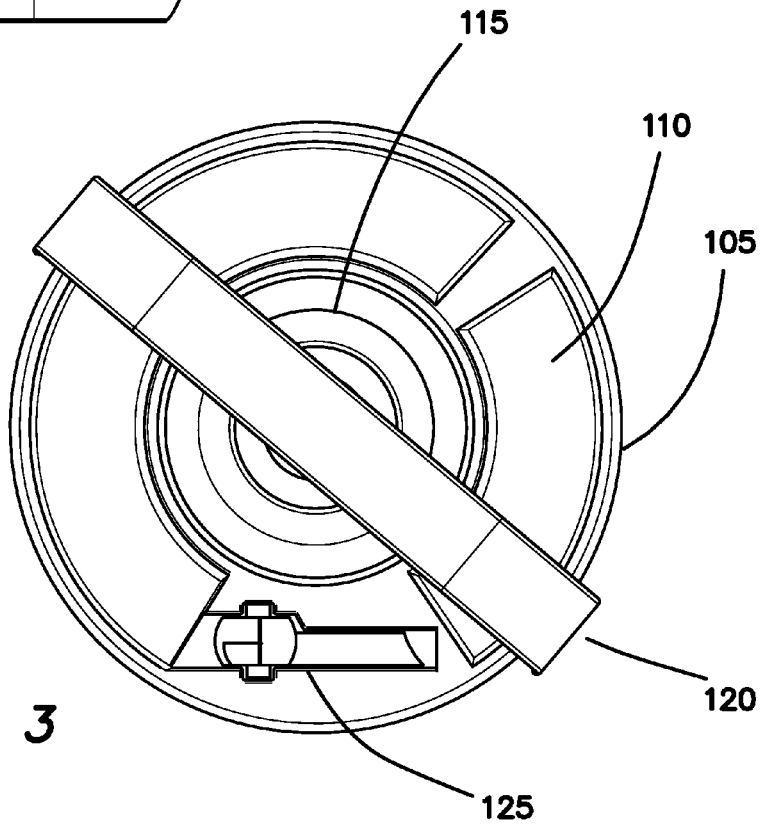
FIG. 3 illustrates a top view of the beverage cooler according to the embodiments of the present invention.
Figure 5A:
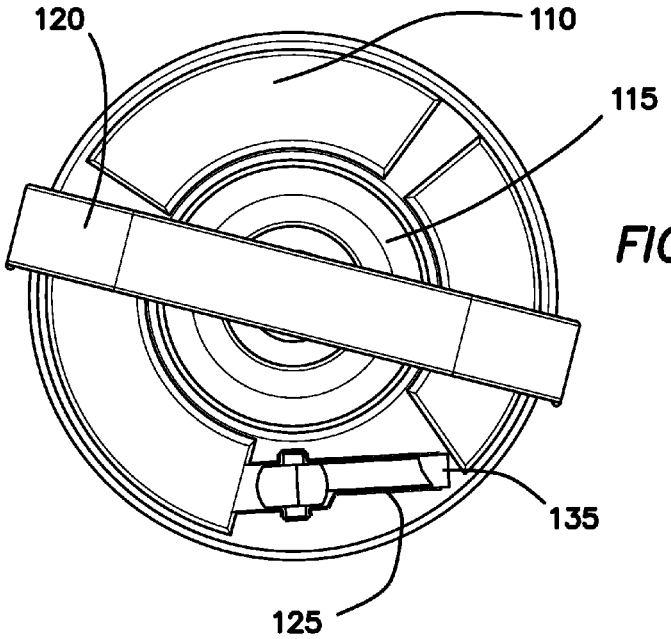
FIGS. 5*a* and 5*b* illustrate a drinking or pouring spout of the beverage cooler according to the embodiments of the present invention.
Figure 5B:
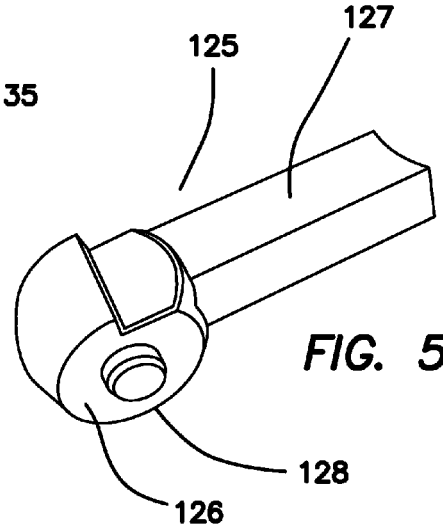
Figure 8:
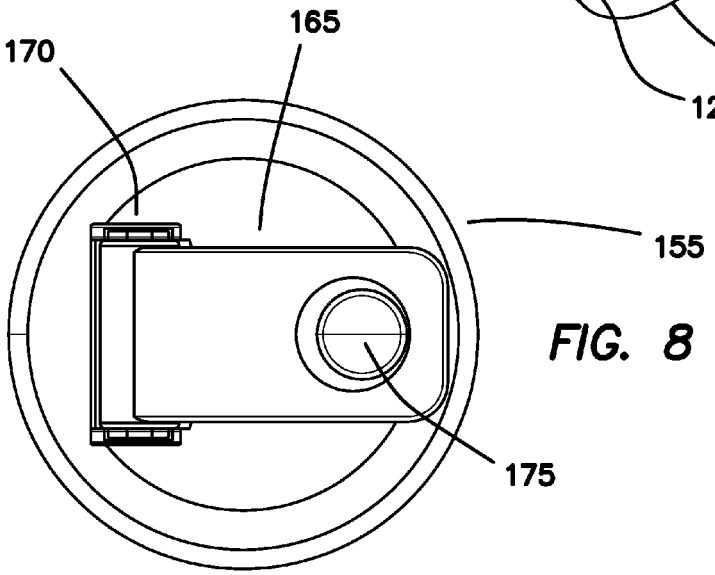
FIG. 8 illustrates a top view of the shaker receptacle according to the embodiments of the present invention.
Figure 6:
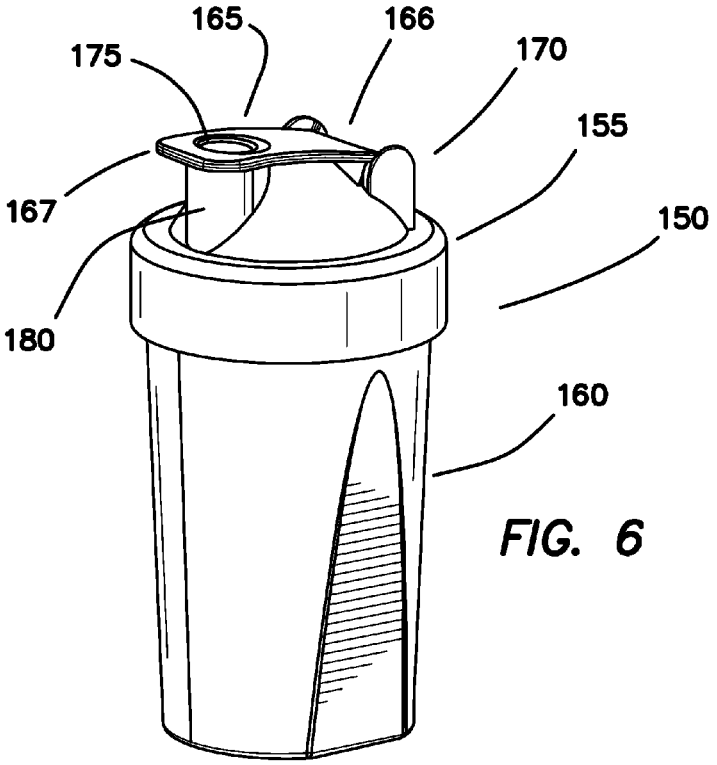
FIG. 6 illustrates a perspective view of a shaker receptacle according to the embodiments of the present invention.
Figure 7:
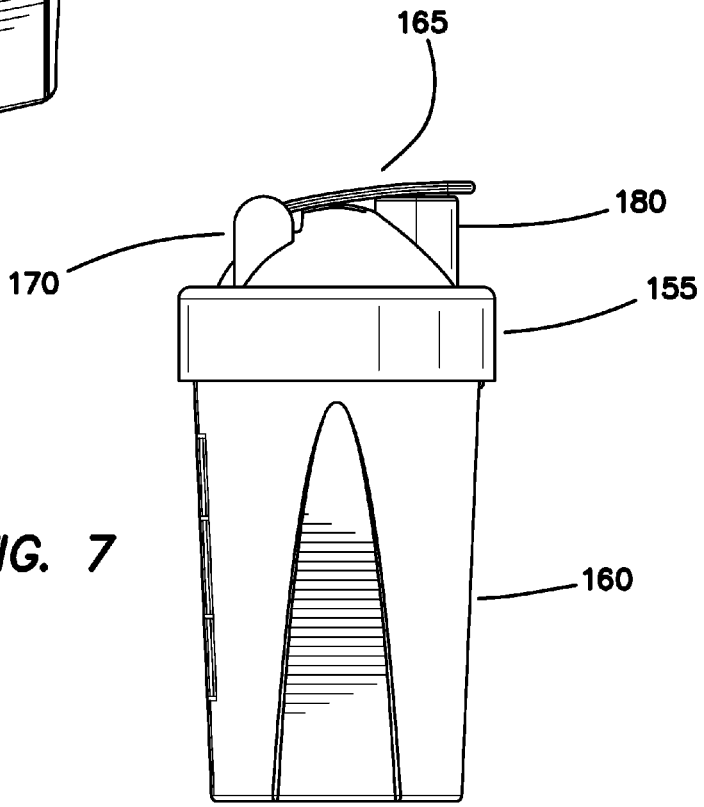
FIG. 7 illustrates a side view of the shaker receptacle according to the embodiments of the present invention.
Figure 9:
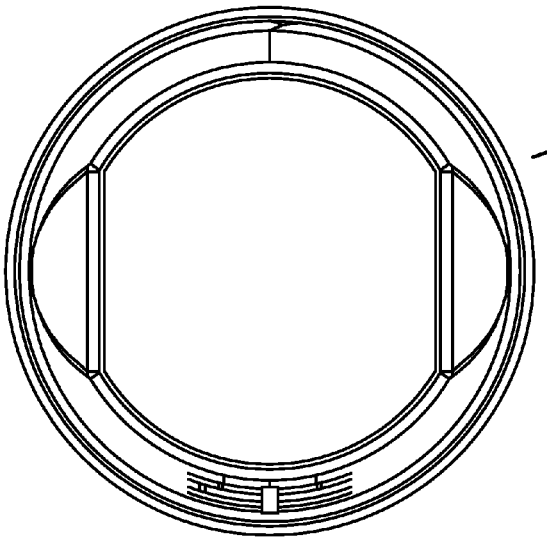
FIG. 9 illustrates a bottom view of the shaker receptacle according to the embodiments of the present invention.

FIGS. 5*a* and 5*b* show the drinking or pouring spout 125 incorporated into the beverage cooler 100 and separated therefrom, respectively. The drinking or pouring spout 125 resides in a recess 135 in the top 110 and includes a circular portion 126 in communication with a drinking or pouring tube 127. A pair of nubs 128 positioned on opposite sides of said circular portion 126 provide means for said drinking or pouring spout 125 to attach to said top 110 and rotate relative thereto. The nubs 128 rotatably fit into cavities 129 in the top 110 within the recess 135. FIG. 3 shows a top view of the beverage cooler 100 with the drinking or pouring spout 125 in the recess 135.

FIGS. 6-9 show a shaker receptacle 150. A shaker receptacle 150 conventionally holds a powder which may be mixed with water or other liquid to create a drink. Normally, the powder is a protein powder, carbohydrate powder, energy powder or other after-workout powder. Mixing the powder with a liquid immediately after the workout allows its temperature to be controlled and drinking the mixture immediately after the workout provides optimum results.

The shaker receptacle 150 comprises two components, namely a removable lid 155 and body 160. In one embodiment, the removable lid 155 includes a threaded inner portion which mates with a threaded, outer top portion of the body

160. A flip cap 165 maintains an opening (not visible) in a closed or open position. One end 166 of the flip cap 165 is rotatably attached to an H-shaped member 170 relative to which the flip cap 165 can rotate. The other end 167 includes a spherical depression 175 configured to frictionally engage the opening in a drinking column 180.

Figure 10:
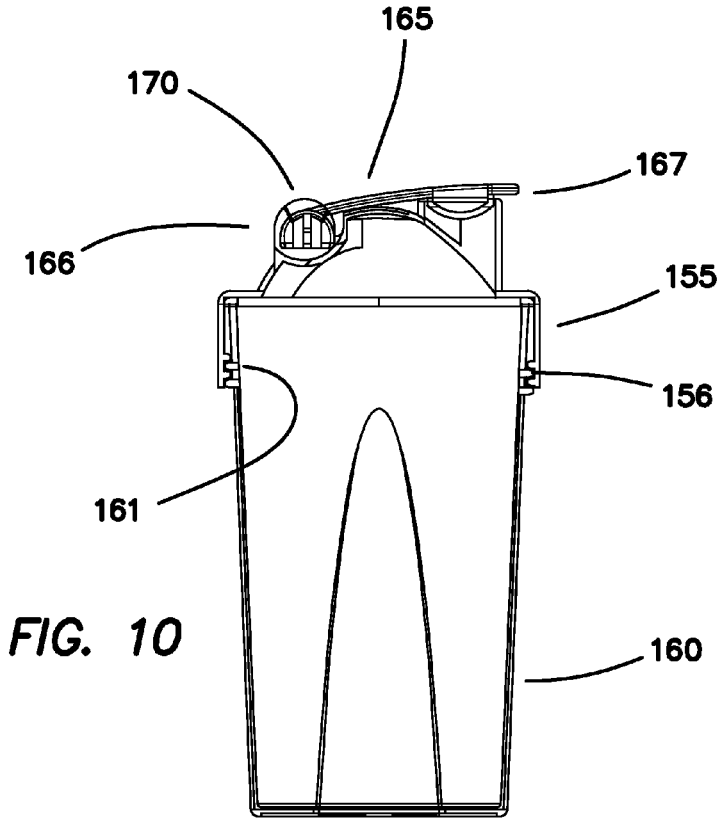
FIG. 10 illustrates a cross-sectional side view of the shaker receptacle according to the embodiments of the present invention.

FIG. 10 shows the internal features of the shaker receptacle 150 namely threads 156 of the lid 155 mating with threads 161 of the body 160 allowing the lid 155 to attach and remove.

Figure 11:
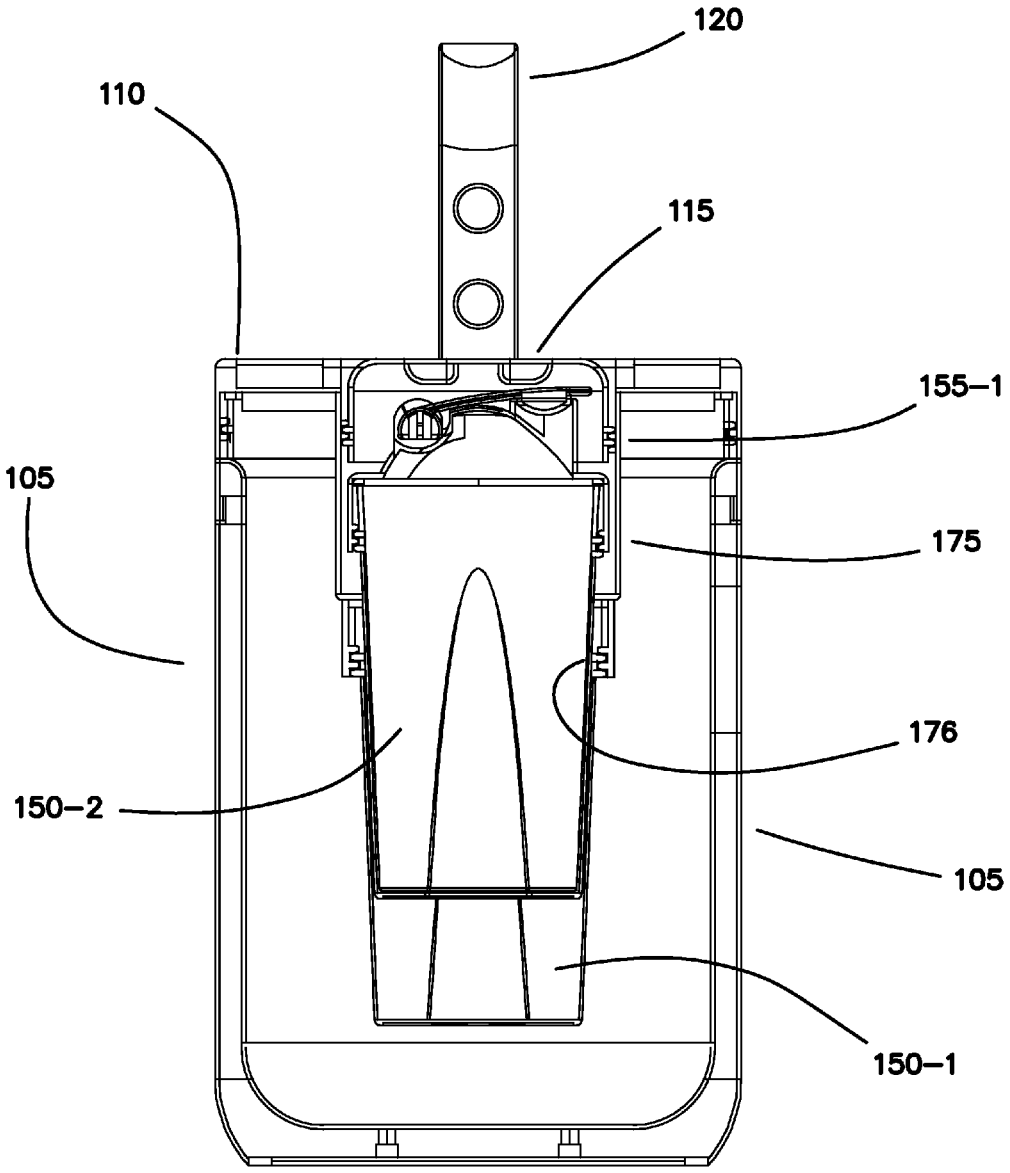
FIG. 11 illustrates a cross-sectional side view of a pair of shaker receptacles in place within the beverage cooler according to the embodiments of the present invention.
Figure 12:
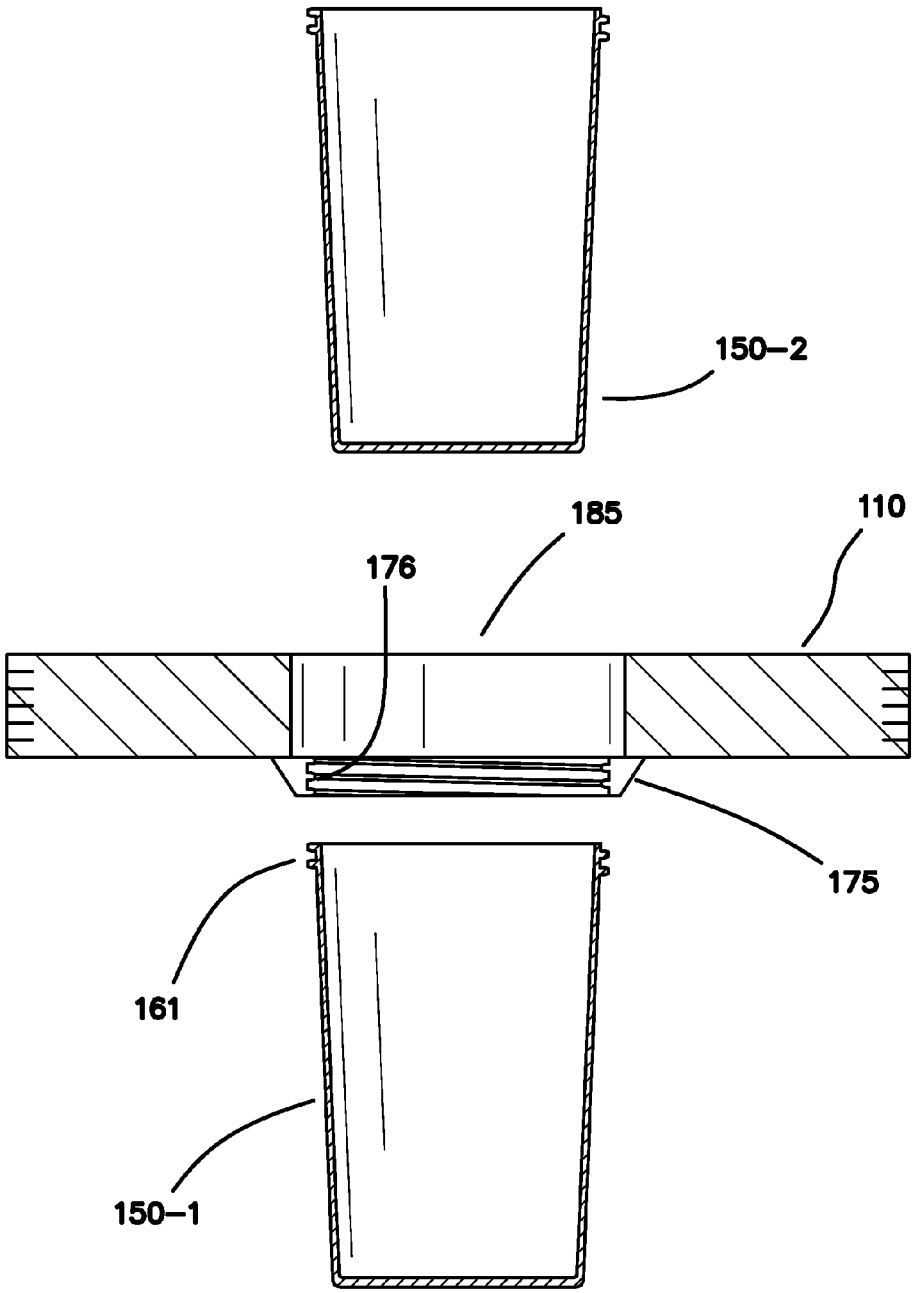
FIG. 12 illustrates a cross-sectional view of a top of the beverage cooler and shaker receptacles according to the embodiments of the present invention.

FIG. 11 shows a perspective, internal view of a pair of shaker receptacles 150-1 and 150-2 in place within the beverage cooler 100 according to the embodiments of the present invention. A first shaker receptacle 150-1 attaches to circular, threaded member 175 extending downward from said top 110 proximate to, and circumscribing, an opening 185 configured to receive the lid 115. As seen in FIG. 12, the threaded member 175 has threads 176 on an inner surface thereof such as to receive the threads 161 of the outer top portion of the body 160 of the shaker receptacle 150-1. When the lid 115 is in place, the shaker receptacle 150-1 is concealed within the housing 105. In practice, with one shaker receptacle 150-1 being used, the shaker receptacle 150-1 rests in a liquid contained within the beverage cooler 100. When needed, the user is then able to remove the top 110 from the housing 105 and disengage the shaker receptacle 150-1, add liquid, attach the shaker receptacle lid and shake. With one shaker receptacle 150-1 being used, the shaker receptacle lid 155 may rest upon the shaker receptacle 150-1 within the housing 105 and beneath the lid 115.

In another embodiment, as best seen in FIG. 11, a second shaker receptacle 150-2 may be inserted into the first shaker receptacle 150-1 with a shaker receptacle lid 155-1 attached thereto. In this arrangement, the first shaker receptacle 150-1 acts a sleeve or barrier against the liquid in the cooler 100 thereby protecting the second shaker receptacle 150-2 from liquid in the beverage cooler 100. The shaker receptacle lid 155-1 may be used interchangeably with both shaker receptacles 150-1 and 150-2.

Although the invention has been described in detail with reference to several embodiments, additional variations and modifications exist within the scope and spirit of the invention as described and defined in the following claims.

I claim:

1. A beverage cooler comprising:

an insulated housing having a bottom and a removable top, said top including a center opening;

a beverage cooler lid configured to removably fit into said center opening;

a threaded member integral with said top and extending downward from an underside of said top into said housing and substantially circumscribing said center opening;

a first shaker receptacle, a second shaker receptacle and a shaker receptacle lid, said shaker receptacle lid configured to attach individually to both said first shaker receptacle and said second shaker receptacle; and wherein said threaded member removably receives said first shaker receptacle by means of threads on an outer, top portion of said first shaker receptacle, said second shaker receptacle, with said shaker receptacle lid attached, configured to insert into said first shaker receptacle such that said second shaker receptacle rests at least partially within said first shaker receptacle with said shaker receptacle lid positioned within said threaded member, said first shaker receptacle creating a barrier between liquid in said housing and said second shaker receptacle.

2. The beverage cooler of claim 1 further comprising a movable spout.

3. The beverage cooler of claim 1 further comprising a handle attached to said top.

4. A beverage cooler comprising:

an insulated, cylindrical housing having a bottom and a removable top, said top including a center opening;

a beverage cooler lid configured to removably fit into said center opening;

a circular member integral with said top and extending downward from an underside of said top and substantially circumscribing said center opening, said circular member having threads on an inner surface thereof;

a first shaker receptacle, a second shaker receptacle and a shaker receptacle lid, said shaker receptacle lid configured to attach individually to both said first shaker receptacle and said second shaker receptacle; and wherein said threads of a threaded member extending downward from said circular member receive threads on an outer, top portion of said first shaker receptacle, said second shaker receptacle, with said shaker receptacle lid attached, configured to insert into said first shaker receptacle such that said second shaker receptacle rests at least partially within said first shaker receptacle with said shaker receptacle lid positioned within said threaded member creating a barrier between liquid in said housing and said second shaker receptacle.

5. The beverage cooler of claim 4 further comprising a movable spout.

6. The beverage cooler of claim 4 further comprising a handle attached to said top.

* * * * *